United States Patent [19]

Seidel

[11] Patent Number: 4,911,188

[45] Date of Patent: Mar. 27, 1990

[54] HYDRAULIC CEILING-CONCRETE REMOVER

[75] Inventor: Jurgen F. Seidel, Calumet City, Ill.

[73] Assignee: Midwest Hydro-Blasting, Inc., Chicago, Ill.

[21] Appl. No.: 163,273

[22] Filed: Mar. 2, 1988

[51] Int. Cl.[4] ..... B08B 3/02

[52] U.S. Cl. ..... 134/56 R; 134/174; 134/198; 134/182; 239/750; 239/743

[58] Field of Search ..... 239/753, 752, 751, 750, 239/263.1, 263, 265, 743; 134/172, 174, 198, 182, 56 R, 57 R; 118/323, 320

[56] References Cited

U.S. PATENT DOCUMENTS

| | | | |
|---|---|---|---|
| 3,027,095 | 3/1962 | Paasche | 239/265 X |
| 3,269,659 | 8/1966 | Shelton et al. | 239/753 |
| 3,274,860 | 9/1966 | Gauther et al. | 239/752 |
| 3,276,695 | 10/1966 | Giardino et al. | 239/265 X |
| 3,736,909 | 6/1973 | Marangoni et al. | 239/753 X |
| 3,817,262 | 6/1974 | Caradeur et al. | 134/172 X |
| 3,957,203 | 5/1976 | Bullard | 239/753 X |
| 4,676,189 | 6/1987 | Takeuchi et al. | 118/326 |

*Primary Examiner*—Frankie L. Stinson
*Attorney, Agent, or Firm*—Welsh & Katz, Ltd.

[57] ABSTRACT

An apparatus and method for removing concrete from a ceiling surface by hydrodemolition which includes a mobile truck unit adapted for movement along a floor surface or the like and which supports a pair of upstanding telescoping support arms having an elongated boom mounted at their upper ends in a manner to enable selective orientation of the boom relative to a ceiling surface. A carriage is mounted for reciprocating movement along the boom and carries an upwardly directed lance and discharge nozzle operative to discharge high pressure fluid, such as water, against a ceiling surface such that selective movement of the nozzle and mobile truck during high pressure fluid discharge are operative to remove concrete from the ceiling surface.

16 Claims, 3 Drawing Sheets

HYDRAULIC CEILING-CONCRETE REMOVER

BACKGROUND OF THE INVENTION

Cement structures, particularly those using reinforced concrete, suffer degradation over time and with use. Cracks often develop and even portions of the cement may dislodge.

The problem becomes particularly acute in regions which include salt as an environmental ingredient. This occurs, of course in localities near the ocean which receive salt directly form the water spray and the like. Furthermore, the salting of roads in the northern portions of this country during winter have an especial destructive effect upon cement structures.

The repair of cement damage by the environment and use generally commences with the removal of the remaining surface layers of concrete. This cleans out degraded or dislodged cement, much like drilling a decayed tooth. Replacing the removed cement with new concrete precludes the further and dangerous degradation of the cement structure.

The removal of cement has often entailed the use of jack hammers generally operating under pneumatic pressure. This type of equipment has proven very slow, requires a large number of employee hours, and thus entails a very substantial ézpense to a structure's owner. It can also create microcracks in the structure.

A more recent type of device employs a strong stream of water, under high pressure, to remove the superficial cement. Typically, a nozzle moves across a boom positioned over a cement floor, roadway, or the like. The boom, in turn, connects to a tractor which moves in the direction generally perpendicular to that in which the nozzle travels. The coordinated motions of the nozzle on the boom moving in a first direction and the tractor holding the boom in a perpendicular direction permits the coverage of a large area of cement floor or roadway with a minimal number of employees. It also produces a smoother surface which admits to a more uniform layer of new cement and thus a stronger resulting structure. The Atlas-Copco Company in Sweden has produced equipment of this type.

However, the hydraulic demolition equipment utilizing a nozzle traveling on a boom attached to a tractor has a limited utility. It only operates upon the upward-facing surface upon which the tractor may sit. This limits its use to cement floors, roadways, aprons, and the like.

However, many cement structures have downwardly facing surfaces as well. This occurs, of course, in buildings. The ceiling surface may also undergo degradation, especially in structures such as parking lots or other areas which suffer heavy wear from vehicles. The search for equipment to effectuate the surface demolition of cement on ceiling surfaces accordingly continues.

One of the primary objects of the present invention is to provide novel apparatus for removing concrete from a ceiling surface.

A more particular object of the present invention is to provide a novel apparatus for removing concrete from a ceiling surface for repair of the ceiling and which employs a mobile support truck adapted for movement along a floor surface or the like. The truck carries a pair of telescoping upstanding support arms which support a transverse boom so as to enable selective orientation of the boom relative to a ceiling surface. A carriage is reciprocally moveable along the boom and carries a lance having a high pressure fluid discharge nozzle thereon operative to discharge high-pressure fluid, such as water, against the ceiling surface as the nozzle and truck undergo predetermined movement relative to the ceiling surface.

A feature of the ceiling concrete removing apparatus in accordance with the present invention lies in the provision of control means at opposite ends of the boom which are operative in response to traverse of the carriage to effect automatic reversal and reciprocating movement of the carriage.

Further objects, advantages and features of the invention, together with the organization and manner of operation thereof, will become apparent from the following description of the invention when taken in conjunction with the accompanying drawings wherein like reference numerals designate like elements throughout the several views.

DETAILED DESCRIPTION

Figure 1:
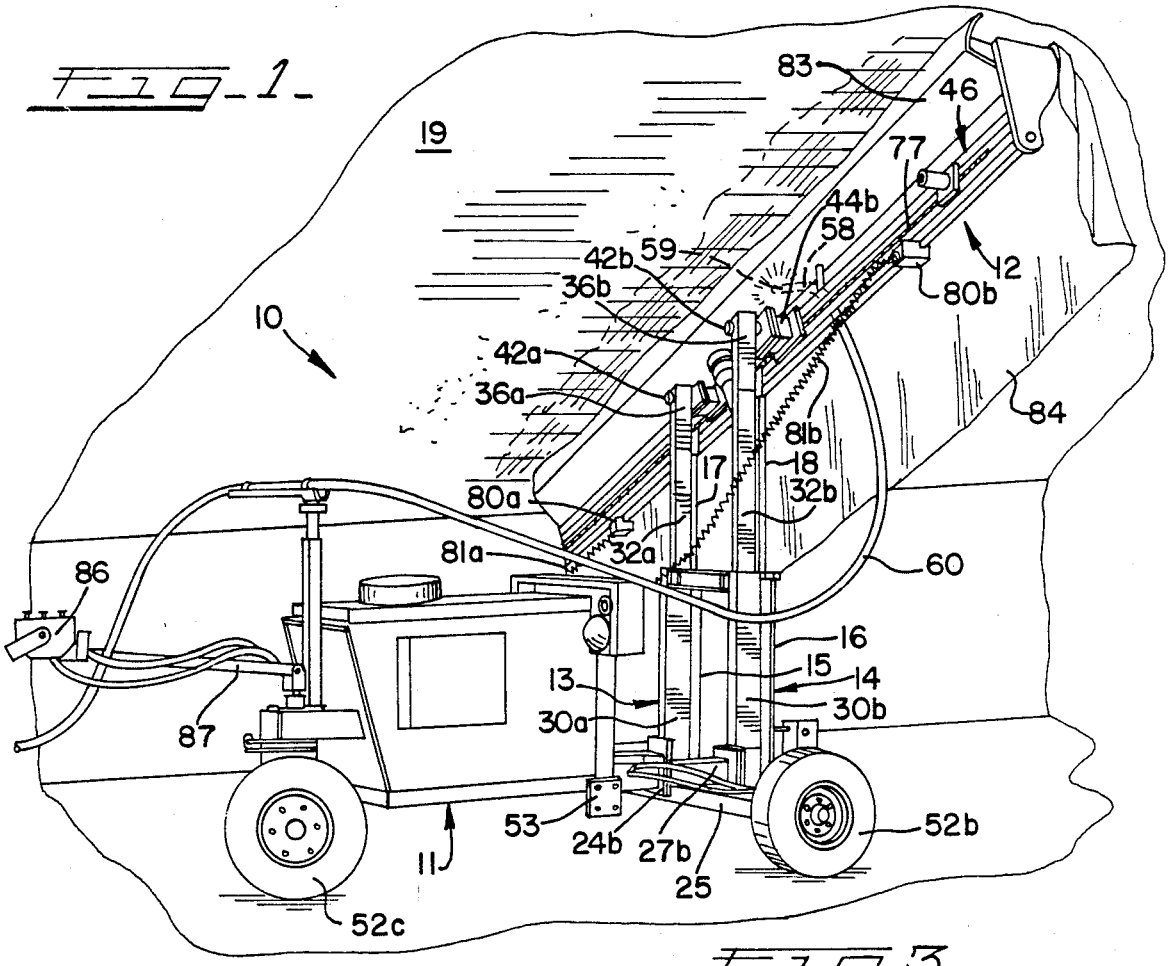
FIG. 1 is a perspective view of an apparatus for removing concrete from a ceiling surface utilizing water under pressure in accordance with the present invention.

Referring to the drawings, apparatus for removing concrete from a ceiling surface, alternatively termed a hydraulic ceilingconcrete remover, is indicated generally at 10 in FIG. 1. The apparatus 10 includes mobile support means in the form of a tractor 11, and elongated boom means in the form of a boom 12. The boom is supported on the upper end of telescoping support arm means in the form of a pair of telescoping upstanding support arms 13 and 14.

Figure 3:
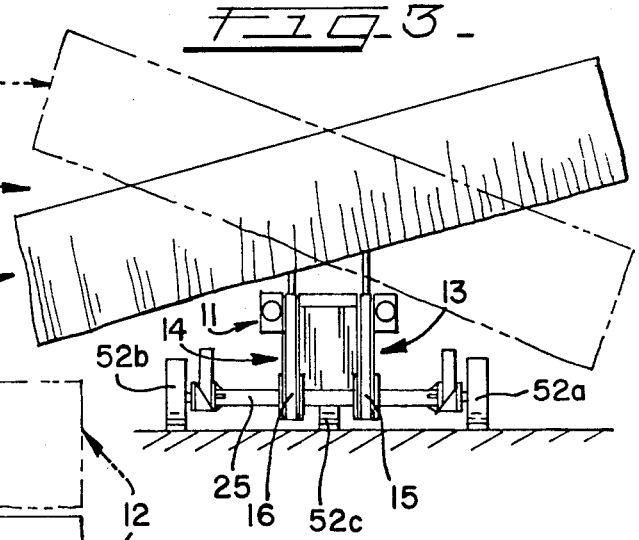
FIG. 3 is a front elevational view of the apparatus of FIG. 2 but with the boom shown tilted in a first angular position in solid lines, and shown in an opposite angular position in phantom.
Figure 2:
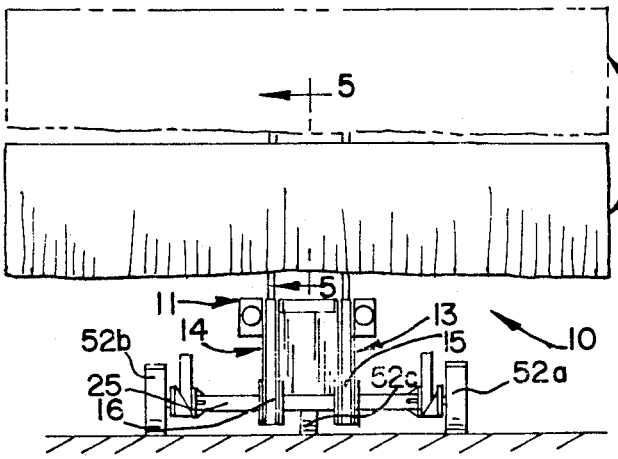
FIG. 2 is a front elevational view of the ceiling concrete removing apparatus of FIG. 1 with the boom shown in a lowered position in solid lines and in an elevated operating position in phantom.
Figure 4:
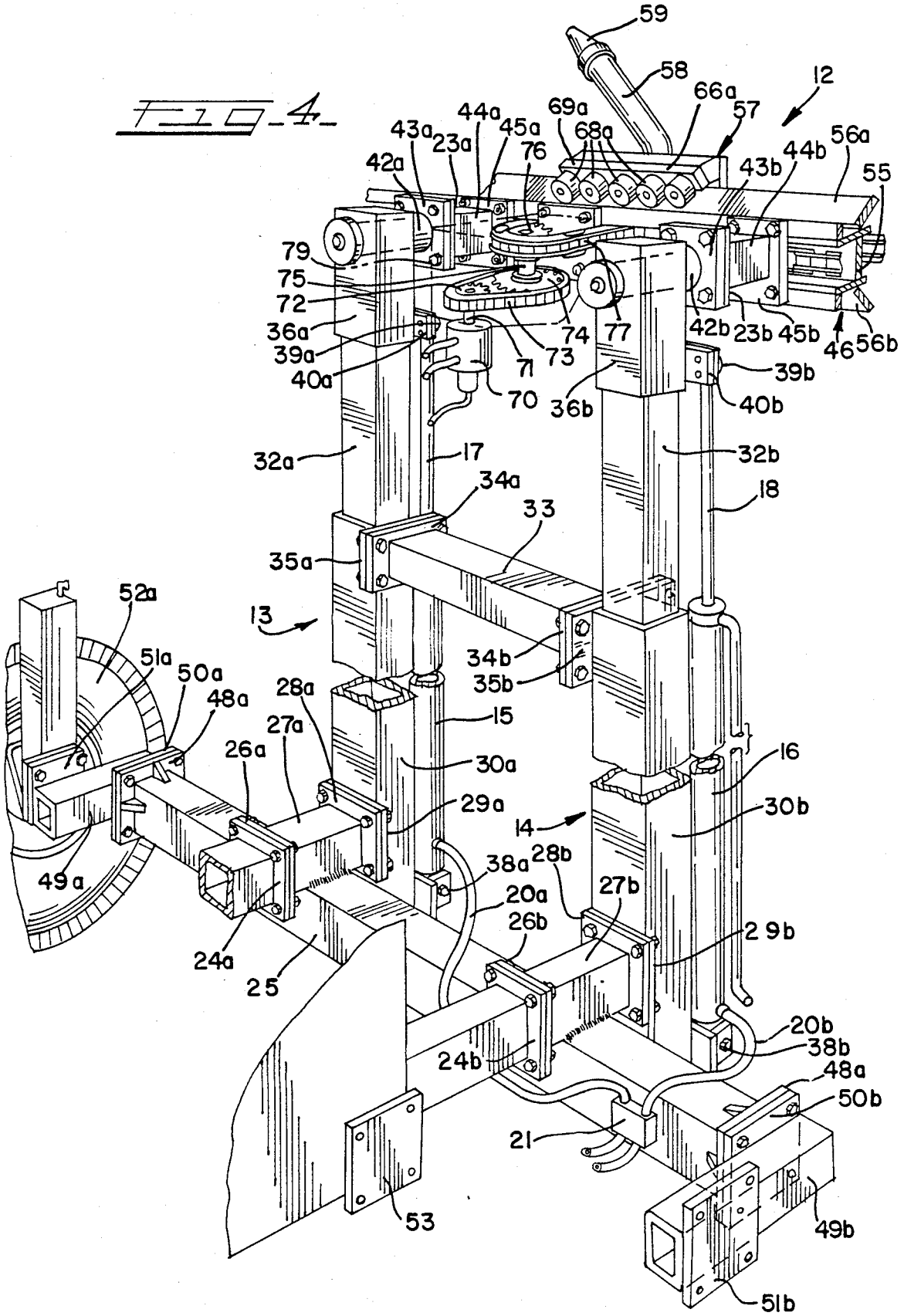
FIG. 4 is a fragmentary perspective view of the concrete removing apparatus of FIG. 1 with portions broken away to illustrate the mechanism for raising and lowering the boom and for effecting traverse of the nozzle and lance carriage along the boom.
Figure 5:
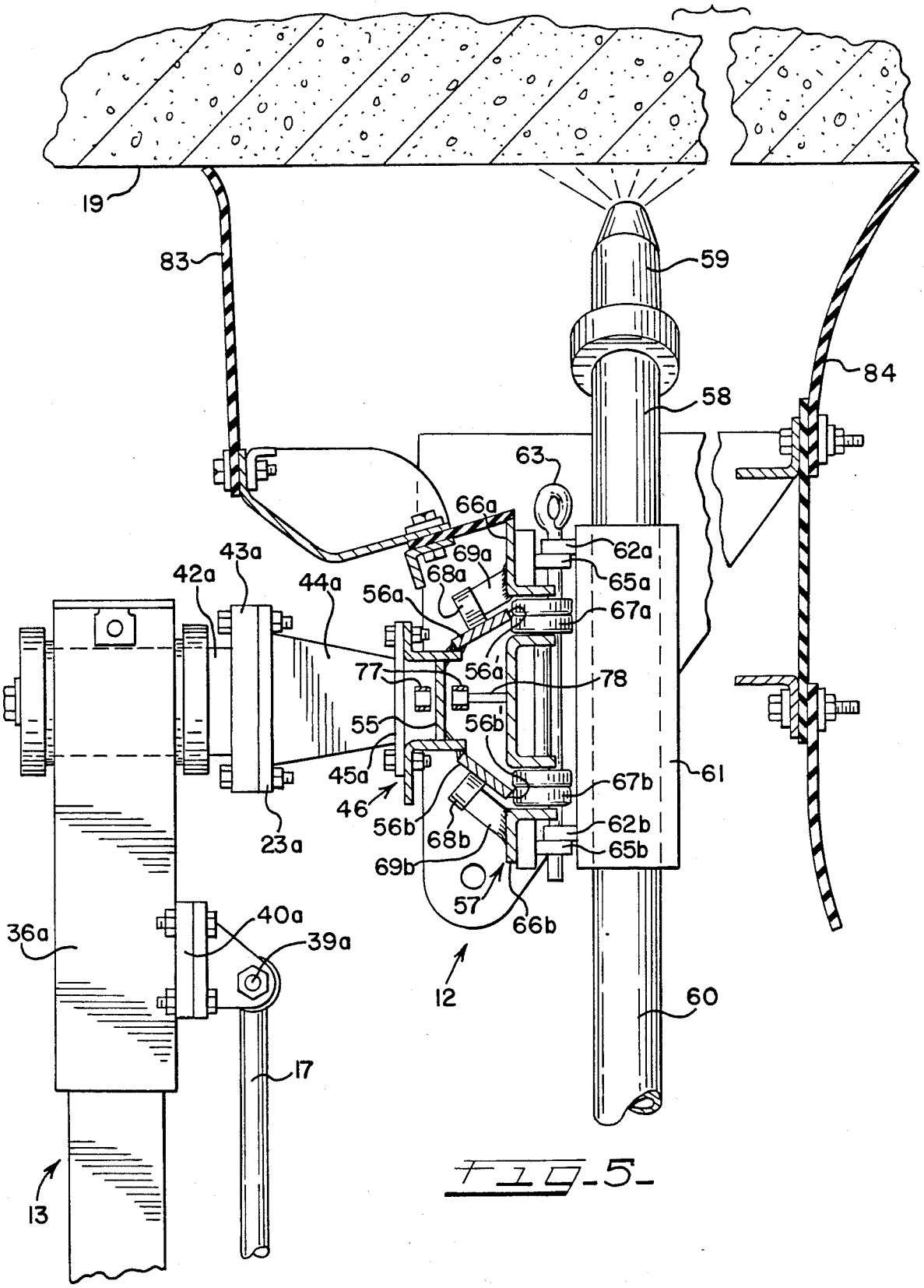
FIG. 5 is an enlarged fragmentary cross-sectional view taken substantially along line 5—5 of FIG. 2.

A pair of hydraulic cylinders 15 and 16 are operatively connected, respectively, to the telescoping arms 13 and 14 and have corresponding extendable piston rods 17 and 18 (FIG. 4) for selective raising and lowering of the boom 12 so as to position it substantially parallel to a ceiling surface, indicated at 19 in FIGS. 1 and 5, for demolition work. The cylinders 15 and 16 comprise actuator means adapted for separate operation so as to enable selective varying of the longitudinal lengths of the support arms 13 and 14 and thereby selective movement of the boom between an elevated operating position, shown in phantom in FIG. 2, and a lowered nonoperating position as shown in solid lines. Since not all concrete ceilings or raised concrete surfaces lie parallel to the underlying floor or support surface on which the tractor 11 may be supported, independent operation of the cylinders 15 and 16 permits the boom 12 to be tilted generally about an axis transverse to the boom as shown in solid and phantom lines in FIG. 3.

As illustrated in FIG. 4, the cylinders 15 and 16 are connected to hydraulic lines or hoses 20a and 20b which are interconnected through a conventional hydraulic lock 21, such as manufactured by the Monson Tison Mfg. Company of Sweden. The hydraulic lock 21 is operative to prevent inadvertent lowering of the boom in the event of hydraulic pressure failure to the cylinders 15 and 16, thereby assisting in safe operation.

The boom 12 may be disconnected from the support arms 13 and 14 and rotated or swung 180 degrees about its transverse axis, and then connected directly to the tractor 11 to remove concrete from a floor surface, thus eliminating the support arms 13 and 14. For this purpose, a pair of boom connecting plates **23*a* and 23*b* may be connectd, respectively, directly to a pair of tractor connecting plates 24*a* and 24*b*. This latter configuration basically constitutes the configuration in which Atlas-Copco Company of Sweden sells its equipment. Since in the removal of concrete from a floor surface the tractor 11** is disposed on the floor undergoing demolition, very little, if any, need exists to adjust the height of the boom relative to the floor surface during demolition.

To convert the boom 12 from a floor demolition condition to a condition for working on a ceiling surface, the boom plates **23*a* and 23*b* are disconnected from the tractor plates 24*a* and 24*b*. A cross bar or support beam 25 is then attached to the tractor plates 24*a* and 24*b* through face plates 26*a* and 26*b* which are fixed to ends of corresponding connecting bars 27*a* and 27*b* welded transversely to the support beam 25. A pair of mounting plates 28*a* and 28*b* are fixed to opposite ends of the connecting bars 27*a* and 27*b* and are adapted for releasable connection to face plates 29*a* and 29*b*, respectively, fixed to outer rectangular sleeves 30*a* and 30*b* of the support arms 13 and 14**.

The upstanding support arms 13 and 14 include upper extendable members **32*a* and 32*b* of rectangular transverse cross section which telescope into the corresponding fixed outer sleeves 30*a* and 30*b*. A rigid beam or bar 33 has end plates 34*a* and 34*b* attached to its opposite ends which are secured to the sleeve 30*a* and 30*b* through mounting plates 35*a* and 55*b* so as to provide structural rigidity for the support arms 13 and 14. Rectangular end caps 36a and 36b are fixed to the upper ends of the extendable members 32*a* and 32*b*, respectively. The hydraulic cylinders 15 and 16 are connected at their lower ends, respectively, to the outer sleeves 30*a* and 30*b* at pivot connections 38*a* and 38*b*, and have the upper ends of their piston rods 17 and 18 suitably pivotally connected at 39*a* and 39*b* to the upper ends of the telescoping members 32*a* and and 32*b* through connector brackets 40*a* and 40*b* fixed to the corresponding end caps 36*a,b***.

Pivot shafts **42*a* and 42*b* pass through and are supported by the end caps 36*a* and 36*b*, respectively, so as to enable rotation of the pivot shafts about their longitudinal axes. A pair of mounting plates 43*a* and 43*b* are fixed to the rearward ends of the pivot shafts 42*a* and 42*b* and facilitate attachment of the boom 12 to the support arms 13 and 14 through the boom connecting plates 23*a* and 23*b* which are fixed on ends of corresponding spacer members 44*a* and 44*b*. The spacer members 44*a,b* have mounting plates 45*a* and 45*b* fixed on their opposite ends, the latter being attached to an elongated boom guide track 46 as by bolts or the like. In this manner, the boom 12 may be adjusted to a predetermined work position relative to the ceiling 19 by selective acutation of the cylinders 15 and 16**.

To help prevent tipping of the tractor 11, the crossbar or beam 25 has end plates **48*a* and 48*b* fixed thereon to which are attached mounting bars 49*a* and 49*b* through mounting plates 50*a* and 50*b*. The mounting bars 49*a* and 49*b* have outer plates 51*a* and 51*b* which factilitate mounting of wheels 52*a* and 52*b* to the opposite ends of the beam 25. When being employed to remove concrete from a floor surface, the wheels 52a and 52b may be fixed directly to the tractor chassis, as through mounting plates, one of which is illustrated at 53 in FIGS. 1 and 4. By mounting the wheels 52*a* and 52*b* on the outer ends of the crossbar 25, an outerigger type arrangement is established which provides greater stability for the tractor 11. This is desirable when the boom 12 is elevated to heights, such as 12 feet, frequently necessary for operating upon ceilings of commercial structures. The tractor 11 also has a steerable third wheel 52*c* which may be rotatably driven through a tractor 11, and thus movement of the boom 12, relative to a ceiling surface. A counterbalance weight (not shown) may be mounted on the front end of the tractor opposite the boom so as to counterbalance the boom 12** and provide greater stability for the tractor.

As illustrated in FIGS. 4 and 5, the boom 12 includes the aforementioned elongated guide track 46 which is comprised of an elongated support beam or angle frame 55 connected to the mounting plates **45*a* and 45*b* and which carries a pair of elongated rail plates 56*a* and 56*b* fixed along the length of the angle frame as by welding. The angle frame 55 and rail plates 56*a,b* establish an elongated guide track to support and guide carriage means in the form of a carriage or sled 57 which carries a tubular lance 58 and an associated fluid pressure discharge nozzle 59** for rectilinear reciprocating movement along the boom.

The lance 58 supports the nozzle 59 at its upper outer end and is connected to a fluid pressure hose 60. The nozzle 59 is operative to direct a stream of high pressure water from the hose 60 against the ceiling surface 19. The lance 58 is supported by a sleeve 61 which has a pair of longitudinally spaced mounting tabs or pivot brackets **62*a* and 62*b* fixed to its outer surface. The pivot brackets define axially aligned openings to receive a quick release support pin 63. The support pin 63 also passes through a the lance chain 77 are preferably enclosed within a suitable housing as illustrated in phantom at 79 in FIG. 4. Control means in the form of a pair of limit switches 80*a* and 80*b* (FIG. 1) are supported generally adjacent opposite ends of the boom 12 and are connected through leads 81*a,b* to a hydraulic control (not shown) for the drive motor 70 so as to automatically reverse the direction of rotation of the drive motor and thereby the direction of traverse of the sled 57 each time the sled engages a limit switch 80*a* and 80*b***.

As the nozzle 59 directs water under pressure upwardly against a ceiling surface, debris and water may spatter downwardly. To confine splatter, a pair of shrouds 83 and 84 are supported along the length of boom so as to provide an enclosure around the nozzle 59 to protect personnel and property in the area. The shrouds 83 and 84 have free upper edges which extend above the height of the nozzle 59 so as to engage the ceiling surface without inhibiting movement of the lance and nozzle.

A more effective and even removal of ceiling concrete occurs if the boom is moved transverse to its longitudinal axis in forward and backward steps to provide a repetitive, back-and-forth motion as the lance and nozzle traverse the boom. One sequence of steps that has proven very effective after positioning the boom generally parallel to and adjacent the ceiling surface involves first moving the lance from one end of the boom to the other end, then moving the tractor 11 so as to move the boom 12 one step in a first direction perpendicular or transverse to the direction of lance travel. The lance and nozzle are then caused to travel back along the boom from the second to the first end by the actuated limit switch 80*a* or 80*b*, and the tractor and boom 12 are moved one step in a second direction opposite to the direction of the prior move. The lance is again caused to traverse the length of the boom by the other limit switch 80*a* or 80*b*, and the tractor and boom are moved a further step in the second direction. This will place the lance on fresh concrete where it can begin the process all over again. Control of movement of the truck 11, along with selective raising, lowering or tilting of the boom 12 and initiating actuation of the lance chain drive motor 70, can be effected from a control console 86 supported forwardly of the truck 11 by a support arm 87.

The upstanding telescoping boom support arms 13 and 14 enable positioning of the boom for operation with 12 foot high ceiling surfaces. The water passing through the hose 60, lance 58, and nozzle 59 is provided by a high pressure water pump that may experience rapid wear during use. Adding a slight amount of oil to the water can help reduce that wear. Thus, adding one-fourth quart of mobile S-122 into the microfilters of the hydraulic pressure system for each 800 gallons of water discharged from the nozzle, or more generally one quart for each 2000 to 6000 gallons of water, can provide a substantial reduction in the wear to the equipment.

What is claimed is:

1. Apparatus for removing concrete from a ceiling surface comprising, in combination;

mobile support means adapted for movement along a support surface beneath a ceiling surface;

upstanding telescoping support arm means supported by said mobile support means, actuator means cooperative with said support arm means in a manner to enable selective varying of the longitudinal length of said arm means, elongated boom means carried by said support arm means proximate an upper end thereof, said boom means defining a rectilinear guide track having first and second ends, carriage means supported on said guide track for movement along said guide track between said first and second ends, a fluid pressure nozzle carried by said carriage in a manner to enable discharge of fluid pressure toward a ceiling surface, means for supplying fluid pressure to said nozzle, drive means operatively associated with said carriage means in a manner to effect movement of said carriage means along said guide track, and control means cooperative with said guide track and said drive means and directly responsive to movement of said carriage means to said first and second ends to reverse the direction of movement of said carriage means, whereby said nozzle is caused to automatically reciprocate along said guide track while discharging fluid pressure against a ceiling surface.

2. The mechanism of claim 1 further including shroud means, coupled to said boom means, for reducing the amount of material moving in a horizontal direction after said nozzle means directs stream of fluid pressure against said ceiling.

3. The apparatus of claim 1 further including coupling means having first and second portions and a quick-release pin with said first portions being coupled to said boom means and engageable with said quick-release pin and said second portions being coupled to said lance means and engageable with said quick-release pin, said coupling means being operative to hold said lance means and said boom means in assembled relation and permitting removal of said lance means and said boom means from each other when said quick-release pin is disengaged from said first and second portions.

4. The apparatus of claim 1 further including hydraulic means for supplying pressurized fluid to said nozzle, and lubricating means coupled to said hydraulic means for adding oil to the fluid provided under pressure to said nozzle means.

5. Apparatus as defined in claim 1 including means interconnecting said boom means to said upstanding support arm means in a manner enabling selective varying of the angular relation of said boom means to said ceiling surface in a substantially vertical plane.

6. Apparatus as defined in claim 1 wherein said support arm means includes a pair of upstanding telescoping support arms, said actuator means comprising fluid pressure cylinder means operatively associated with each of said telescoping support arms so as to enable selective varying of the longitudinal lengths of said support arms independent of each other.

7. Apparatus as defined in claim 6 wherein said boom means is pivotally supported by said support arms adjacent upper ends thereof such that selective varying of the longitudinal lengths of said support arms pivots said boom means about a generally horizontal axis substantially transverse to said rectilinear guide.

8. Apparatus asa defined in claim 6 including fluid pressure control means coupled to said fluid pressure cylinder means and operative to maintain said support arms in fixed longitudinal relation in the event of fluid pressure failure to said cylinder means.

9. Apparatus as defined in claim 1 wherein said drive means includes chains means supported along the length of said boom means and having opposite ends connected to said carriage means, and a fluid pressure motor operatively connected to said chain means in a manner to effect movement of said carriage means along said guide track in response to actuation of said fluid pressure motor, said fluid pressure motor being reversible in response to actuation of said control means by said carriage means.

10. Apparatus as defined in claim 1 wherein said carriage means is supported for reciprocating rectilinear movement along said guide track by a plurality of guide bearings, said fluid pressure nozzle being supported on said carriage means in an upwardly facing discharge direction by a tubular lance having connection to said fluid pressure supply means.

11. Apparatus as defined in claim 1 wherein said mobile support means comprises a truck vehicle enabling movement of said boom means in a direction substantially transverse to said rectilinear guide track.

12. Apparatus as defined in claim 1 including a pair of shrouds supported along the length of said boom means so as to engage a ceiling surface during concrete removal and limit dispersion of material removed from the ceiling.

13. A mechanism for removing concrete from the surface of a concrete ceiling comprising, in combination:

(A) nozzle means for directing a stream of water under pressure in a particular direction;

(B) hydraulic means, coupled to said nozzle means, for providing water under pressure to said nozzle means;

(C) lance means, coupled to said nozzle means, for holding said nozzle means;

(D) elongated boom means, having first and second ends and coupled to said lance means, for holding said lance means at any point along said boom;

(E) driving means, coupled to said boom means and said lance means, for moving said lance means along said boom;

(F) first holding means, coupled to said first end of said boom means, for maintaining said first end of said boom at any of a plurality of first predetermined heights;

(G) first adjusting means, coupled to said first holding means, for moving said first end of said boom between said first predetermined heights;

(H) second holding means, coupled to said second end of said boom means, for maintaining said second end of said boom at any of a plurality of second predetermined heights;

(I) second adjusting means, coupled to said second holding means, for moving said second end of said boom between said second predetermined heights;

(J) moving means, coupled to said first and second holding means, for moving said first and second holding means and said boom means along said ceiling;

(K) first and second coupling means, coupled to said moving means and to said first and second holding means, respectively, for releasably connecting said first and second holding means to said moving means;

(L) third and fourth holding means for holding said boom means in the vicinity of the surface upon which said moving means rests with said nozzle directing a stream of water in a downward direction; and (M) third and fourth coupling means, coupled to said moving means and said third and fourth holding means, for releasably connecting said third and fourth holding means to said moving means.

14. The mechanism of claim 13 wherein said first and second coupling means includes extension means for retaining said boom means at distances from said moving means greater than the distances at which said third and fourth coupling means holds said boom means from said moving means.

15. The mechanism of claim 14 wherein said extension means is a first extension means and further including (1) a plurality of wheels, coupled to said moving means, said moving means moving said wheels to effectuate movement of said boom means along said ceiling, and (2) second extension means, coupled between said moving means and said wheel means, for increasing the distance between said wheels and said moving means.

16. Mechanism for removing concrete from the surface of a concrete ceiling comprising, in combination:

(A) nozzle means for directing a stream of water under pressure in a particular direction;

(B) hydraulic means, coupled to said nozzle means, for providing water under pressure to said nozzle means;

(C) lance means, coupled to said nozzle means, for holding said nozzle means;

(D) elongated boom means, having first and second ends and coupled to said lance means, for holding said lance means at any point along said boom;

(E) driving means, coupled to said boom means and said lance means, for moving said lance means along said boom;

(F) first holding means, coupled to said first end of said boom means, for maintaining said first end of said boom at any of a plurality of first predetermined heights;

(G) first adjusting means, coupled to said first holding means, for moving said first end of said boom between said first predetermined heights;

(H) second holding means, coupled to said second end of said boom means, for maintaining said second end of said boom at any of a plurality of second predetermined heights;

(I) second adjusting means, coupled to said second holding means, for moving said second end of said boom between said second predetermined heights;

(J) moving means, coupled to said first and second holding means, for moving said first and second holding means and said boom means along said ceiling; and (K) control means, coupled to said driving means and to said moving means, for:

(a) causing said driving means to move said lance means in a first substantially straight direction along said path from said first end to said second end;

(b) causing said moving means to move said boom means for a particular distance in a second direction substantially perpendicular to said first direction;

(c) causing said driving means to move said lance means in a third direction substantially opposite to said first direction from said second end to said first end;

(d) causing said moving means to move said boom means in a fourth direction substantially opposite to said second direction by an amount equal substantially to said p distance;

(e) causing said driving means to move said lance means in said first direction from said first end to said second end;

(f) causing said moving means to move said boom means in said fourth direction by an amount substantially equal to said particular amount; and (g) repeating steps (a) through (f) above.

* * * * *

UNITED STATES PATENT AND TRADEMARK OFFICE

CERTIFICATE OF CORRECTION

PATENT NO. : 4,911,188

DATED : March 27, 1990

INVENTOR(S) : Jurgen F. Seidel

It is certified that error appears in the above-identified patent and that said Letters Patent is hereby corrected as shown below:

Column 1, line 27, "ezpense" should be --expense--.

Column 2, line 46, "ceilingconcrete" should be --ceiling-concrete--.

Column 4, line 49, after "a" insert:

pair of pivot flanges or tabs 65a and 65b which are fixed to the carriage or sled 57. Lifting the pin 63 vertically permits removal of the sleeve 61 from the carriage 57 and facilitates servicing or replacement of the sleeve, lance and nozzle.

The carriage or sled 57 includes a pair of parallel angles 66a and 66b which support upper and lower pairs of bearings 67a and 67b such that the bearings ride against free edges 56'a and 56'b on the rails 56a and 56b. The angles 66a and 66b also support upper and lower rows of guide bearings 68a and 68b through mounting blocks 69a and 69b, respectively, such that the bearings 68a,b ride along upwardly and downwardly facing surfaces of the rails 56a,b.

It is certified that error appears in the above-identified patent and that said Letters Patent is hereby corrected as shown below:

The bearings 67a,b and 68a,b thus cooperate to maintain the carriage or sled 57 mounted on the boom rails 56a and 56b and enable reciprocating movement of the sled along the length of the boom.

The sled 57 and associated lance 58 and nozzle 59 are caused to selectively traverse the length of the boom 12 by drive means in the form of a reversible hydraulic motor 70 (FIG. 4) having a drive shaft 71 on which is mounted a drive sprocket 72. An endless drive chain 73 interconnects the sprocket wheel 172 to a second driven sprocket 74 fixed to the lower end of an upstanding axle 75 on which an upper sprocket wheel 76 is fixedly mounted. A lance chain 77 is supported by boom angle frame 55 so as to extend the full length of the angle frame and is passed about the sprocket 76 and about a pair of sprockets (not shown) at the opposite ends of the angle frame so that opposite ends

UNITED STATES PATENT AND TRADEMARK OFFICE

CERTIFICATE OF CORRECTION

PATENT NO. : 4,911,188

DATED : March 27, 1990

INVENTOR(S) : Jurgen F. Seidel

It is certified that error appears in the above-identified patent and that said Letters Patent is hereby corrected as shown below:

of the lance chain are passed back along the side of the angle frame opposite the drive sprocket 76 and are connected to the sled 57 by connecting brackets or tabs, one of which is shown at 78 in FIG. 5. In this manner, selective rotation of driven sprocket 76 through the drive motor 70 effects selective movement of the sled 57 along the length of the boom. The chain and sprocket drive interconnecting the drive motor 70 to Column 6, line 42, after "guide" insert --track--.

Column 6, line 43, "asa" should be --as--.

Column 6, line 49, "chains" should be --chain--.

Signed and Sealed this

Twentieth Day of August, 1991

*Attest:*

*Attesting Officer*

HARRY F. MANBECK, JR.

*Commissioner of Patents and Trademarks*